United States Patent [19]

Jaworski

[11] 4,422,191

[45] Dec. 27, 1983

[54] HYDROTHERAPY JET FOR TUBS, SPAS OR POOLS

[75] Inventor: William R. Jaworski, Minneapolis, Minn.

[73] Assignee: Jope Manufacturing Company Inc., Minneapolis, Minn.

[21] Appl. No.: 427,847

[22] Filed: Sep. 29, 1982

[51] Int. Cl.[3] ..... A04H 3/18; A61H 33/02; E03C 1/02

[52] U.S. Cl. ..... 4/496; 4/541; 4/542; 4/492; 128/66; 239/428.5

[58] Field of Search ..... 4/541, 542, 543, 492, 4/496, 490; 128/66; 239/428, 428.5

[56] References Cited

U.S. PATENT DOCUMENTS

| | | | |
|---|---|---|---|
| 3,541,616 | 11/1970 | Stricker | 4/542 |
| 3,745,994 | 7/1973 | Kane | 128/66 |
| 3,905,358 | 9/1975 | Jacuzzi | 128/66 |
| 3,985,303 | 10/1976 | Steimle | 128/66 X |
| 4,082,091 | 4/1978 | Kaab | 4/559 X |
| 4,261,347 | 4/1978 | Spencer, III et al. | 239/428.5 X |
| 4,262,371 | 4/1981 | Berry et al. | 4/492 X |

*Primary Examiner*—Henry K. Artis
*Attorney, Agent, or Firm*—James V. Harmon

[57] ABSTRACT

A hydrotherapy jet is described in which a nozzle is mounted for universal swiveling motion. Water and air enter through concentric pipes to provide an outer annular water vortex, an inner water vortex and an intermediate air lamina. The water vortices strike one another with considerable force vigorously incorporating air from the intermediate air lamina.

14 Claims, 5 Drawing Figures

HYDROTHERAPY JET FOR TUBS, SPAS OR POOLS

FIELD OF THE INVENTION

This invention relates to jets used in pools, spas, tubs and the like for hydromassage or hydrotherapy in which an air induction system is provided for introducing air into a pressurized water stream.

THE PRIOR ART

The increasing use of hydrotherapy or hydromassage jets in tubs, spas and pools in recent years has resulted largely from a greater interest in the recreational and therapeutic use of tubs and spas particularly in the home. Several hydrotherapy jets have been in commercial use. In these devices, water is usually supplied under pressure from a pump driven by an electric motor. An aspiration arrangement is provided within the jet to incorporate air into the water stream. The presence of sufficient air as bubbles of the proper size is important in obtaining an effective body massage as well as the subjective feel of pressure as judged by placing the hand a predetermined distance from the jet. Thus, if the air supply is cut off, the body massage effect and the feel of pressure against the hand exerted by the emerging water stream drops drastically. In a typical test, the hand is placed in the water 12 inches from the jet nozzle with the jet in normal operation. When the air supply is cut off, the apparent pressure exerted against the hand appears to be only a small fraction, say $\frac{1}{3}$ to $\frac{1}{4}$ of what it was originally. This demonstrates the importance of efficiently introducing air into the water stream to obtain a maximum massaging effect. The jets that are presently available while highly effective do not achieve maximum efficiency in the induction of air. Accordingly, a portion of the power used to drive the electric motor is wasted. Some of the previous jets have also been unsatisfactory with respect to the size of the bubbles of air entrained in the stream. This too reduces the sensation of pressure.

Another problem associated with prior jets is the difficulty associated with installation and plumbing. This results from two causes. First, many prior units are not compact in design, so that the housing protrudes a substantial distance, often six or eight inches, outwardly from the outside surface of the tub after installation. As a result, a large clearance space must be allowed around the outside of the tub. Another problem is the necessity in many prior jets of spacing the water feed pipe a substantial distance away from the tub wall at the point where it connects to the jet housing. This requires even more space around the tub for installation. Thus, most prior hydrotherapy jets are not well suited for installation in a small space. Installation is also time consuming. Another problem is the interdependence of air and water feed pipe positions so that when the position and orientation is selected for the water pipe it may turn out to be a bad angle for connecting the air supply pipe. This results from the fact that a change in position of the water inlet duct will also change the position of the air inlet duct.

U.S. Pat. No. 3,471,091 describes a hydrotherapy fitting for a tub or spa with a housing in which a nozzle is universally mounted. The nozzle is provided with a throat of reduced diameter. An air tube includes an air port located at the center axis of the nozzle and spaced axially from the throat of the nozzle. Both the water inlet duct and the air inlet duct are perpendicular to the wall of the tub upon which the unit is mounted.

U.S. Pat. No. 3,905,358 describes another hydrotherapy jet including an air tube with a port at the center axis of an axial flow passage within a movable nozzle. The passage in the nozzle also has a reduced diameter throat spaced axially from the port. In this case, the water supply duct is perpendicular to the wall of the pool or tub and the air tube is parallel to it. In both of these units, because water enters in alignment with the axis of the nozzle, i.e. normal to the tub surface, either a T joint or an elbow must be provided to connect the incoming water supply pipe.

SUMMARY OF THE INVENTION

In accordance with the invention, a hydrotherapy jet is provided with spaced apart concentric inner and outer water vortices separated by an annular lamina of air. The jet includes a housing with a movable nozzle having a passage for water and air extending through it. The nozzle is universally supported within a ball socket located in the housing.

Means is provided at the inlet end of the nozzle for producing a central water stream aligned axially with the passage in the nozzle and flowing toward it. A means is also provided to produce an outer annular, i.e. tubular water stream positioned concentrically around the central stream. The annular air lamina separates the water streams. During operation, the air stream becomes incorporated into the combined water streams as the two water streams vigorously strike one another. This action enhances the entrainment of air in the combined water stream expelled through the nozzle.

The jet body or housing has a water inlet duct which in accordance with the present invention is positioned parallel to the plane of the tub wall when the jet is installed, i.e. perpendicular to the center axis of the nozzle. Mounted within ball socket is an eyeball or ball portion of the nozzle. The socket communicates with the inlet duct so that water will flow from the inlet duct through the nozzle mounted in the socket.

In a preferred form of the invention, two concentric tubes are provided in the housing. These tubes terminate in outlet openings spaced from the nozzle. From their open ends the tubes extend away from the inlet opening in the nozzle. The inner concentric tube comprises a central water tube aligned axially with the center of the nozzle ball. The outer tube is spaced away from the center tube to define an annular space between itself and the center tube. The annular space between these tubes comprises an annular air inlet duct displaced outwardly, i.e. peripherally from the axis of the nozzle. The space between the outer tube and the inlet of the nozzle serves as a circular mouth for conducting a portion of the water from the inlet duct into the nozzle. The central tube communicates with the water inlet duct, for example, through a small opening in one wall of the outer tube. In this way, the two concentric water vortices are defined, one of which flows into the mouth at the entrance to the nozzle and the other one of which flows directly from the central tube into the center of the nozzle along its axis. The intermediate lamina of air is supplied through the annular duct between the inner and outer tubes. The inner surface of the outer water vortex and the outer surface of the central water vortex are both exposed to the intermediate lamina of air that enters through the annular air inlet duct. This helps air in the intermediate lamina to become incorporated into the combined water stream in the form of small bubbles.

In a preferred form of the invention, the air inlet duct is located in alignment with the center axis of the nozzle and normal to the tub wall while the water supply pipe and water inlet duct are positioned normal to the air supply duct.

The hydrotherapy jet also includes a nozzle containment chamber that is open to the interior of the tub or spa. At the center of this chamber is located the ball socket which holds the nozzle. The containment chamber encloses the nozzle and provides an outlet for the high velocity jet of water and air expelled through the nozzle. The chamber includes a side wall that is closed upon itself and is spaced radially from the center axis of the nozzle. The side wall terminates in an open rim that serves as a mounting surface adapted to be secured to the wall of the tub or spa. The chamber also includes an end wall in which the ball socket is located. The water inlet duct is parallel to the mounting surface and adjacent to the end wall of the containment chamber.

DETAILED DESCRIPTION

Figure 1:
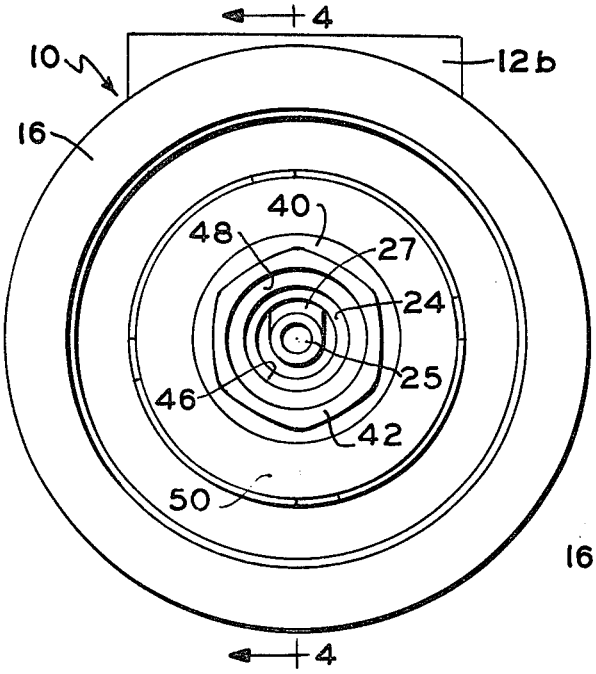
FIG. 1 is a front elevational view of a hydrotherapy jet in accordance with the invention.

As shown in the figures, a hydrotherapy unit is provided including a housing or jet body 10 composed of three major components, a water inlet duct 12, a nozzle containment chamber 18 and an intermediate chamber 22 between them that serves as a water passage allowing water to flow from the water inlet duct 12 to a nozzle 40 mounted within the chamber 18. The hydrotherapy jet can be formed from a variety of materials. Thermoplastic resinous materials such as polyvinyl chloride or ABS resin are preferred.

The water inlet duct 12 includes an upper circular mouth 12*a* and an outer cylindrical surface 12*b*. Into the open end of the mouth 12*a* is slip fitted a section of water feed pipe (not shown) such as plastic pipe which is held in place by well-known solvent welding techniques. In the duct 12 is a reduced bore 14 forming a shoulder to locate the end of the supply pipe. Adjacent water inlet duct 12 is an air inlet 15 which is provided with an enlarged mouth at 26 aligned with the axis of chamber 18 and nozzle 40 for the insertion of an air supply pipe (not shown).

The nozzle containment chamber 18 includes a side wall 18*c* that is closed upon itself and in this case is cylindrical in shape. Chamber 18 has a radially projecting circular rim that serves as a tub mounting flange 18*a* including an outer flat surface 16 which engages the outer surface of tub wall 21. The tub wall 21 is provided with a bored opening through which extends a retaining collar 19 that is screwthreaded at 19*a* into the cylindrical wall 18*c* to hold the jet housing 10 in place on the tub 21 as shown in FIG. 4. A suitable adhesive or sealing gasket (not shown) can be used between the tub wall and the hydrotherapy unit as desired. The collar 19 is ring-shaped and includes a large central opening 19*b* for the nozzle 40 to be described below. Chamber 18 has a flat end wall 18*b* with an axial projection 20 (FIGS. 2–4) for a ball retaining ring to be described below.

Figure 2:
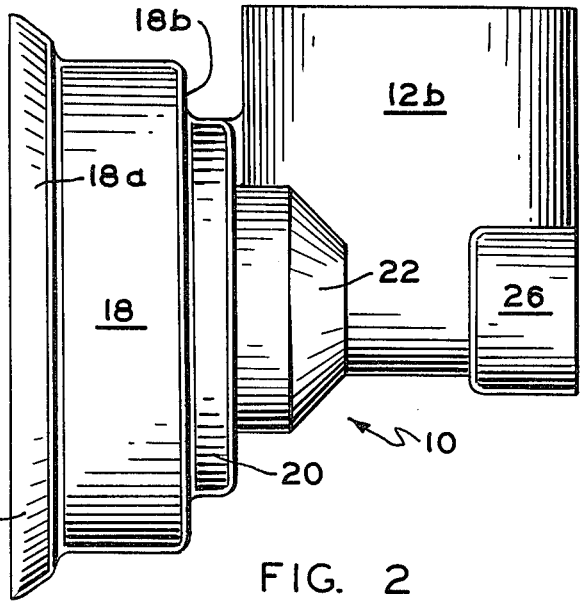
FIG. 2 is a side elevational view of the jet of FIG. 1.

The intermediate chamber 22 communicates at its left end as seen in FIGS. 2 and 4 with the nozzle 40 to be described below and its other end with the interior of the water duct 12. In this way, water passes from the inlet duct 12 to the nozzle 40.

Centered within the chamber 22 are two concentric tubes including an outer tube 24 and an inner tube 25 spaced inwardly therefrom to form an annular air duct 15*a* between them. The air duct 15*a* communicates with the air inlet 15. It can be seen that the two concentric ducts 24 and 25 extend from their free ends away from the nozzle 40 toward the right and are integral with the walls of the housing of the hydrotherapy jet 10.

Figure 3:
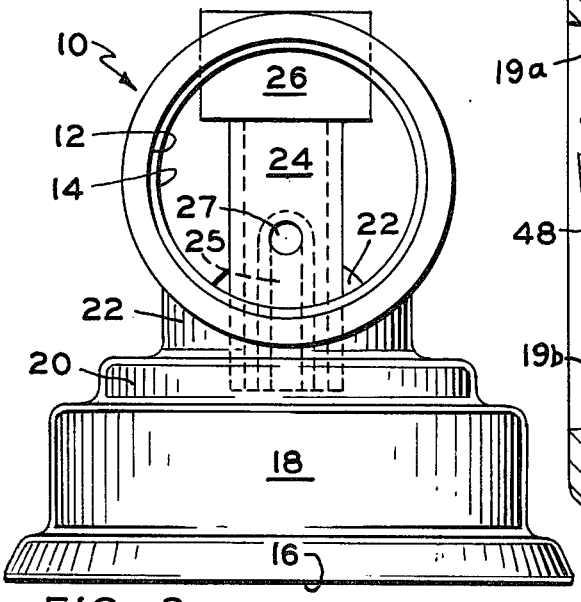
FIG. 3 is a top view of the jet.
Figure 4:
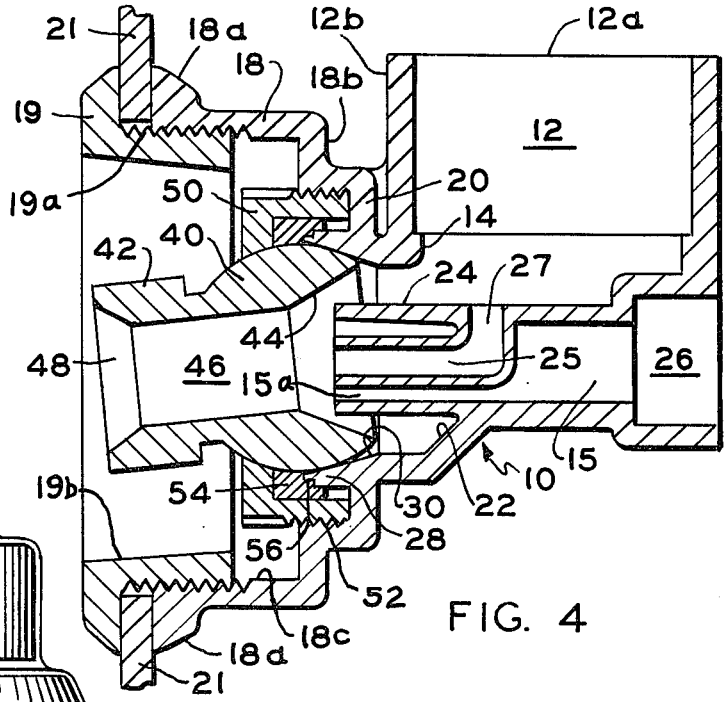
FIG. 4 is a vertical sectional view taken on line 4—4 of FIG. 1.
Figure 5:
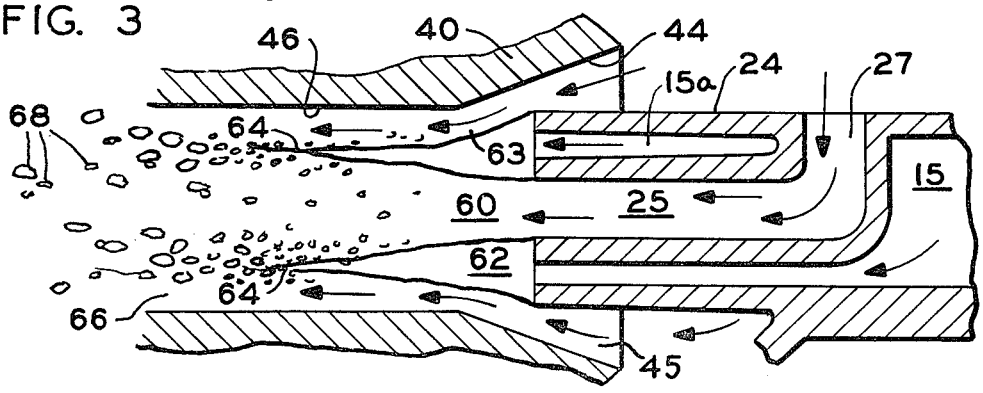
FIG. 5 is a partly diagramatic enlarged view of the nozzle and inlet ducts adjacent to it to show the operation of the invention.

As seen in FIGS. 3–5, the inner pipe 25 bends upwardly at the end thereof most distant from the nozzle 40 and communicates through an opening 27 with the interior of the water inlet duct 12. In this way, the water from the duct 12 flows through the opening 27 into pipe 25 to form the central water vortex. While the hole 27 can be positioned to one side, it is preferred that it point in the direction of the stream of water entering duct 12. This helps to funnel water into pipe 25.

Centrally located within the end wall 18*b* of the nozzle chamber 18 is a generally conical ball socket tapered outwardly in the direction of the nozzle containment chamber 18 and having its smallest crossectional diameter at the junction with the chamber 22. Universally supported within the socket 30 is a nozzle having an eyeball 40 of spherical configuration with an outward extension 42 at its free end, i.e. the left end as seen in FIG. 4 which serves as a positioning knob, and a central passage 46 of cylindrical shape having an inlet at its right end in the figures communicating with the water inlet duct 12. The inlet can comprise an inlet cone or funnel 44 to help guide the flow of the fluid into passage 46. At the other end of the passage 46 is an outlet 48 which if desired may have a beveled edge defining a conical outlet opening 48.

The nozzle or eyeball 40 is held for universal swiveling motion within the socket 30 by means of a ball retaining ring 50 that is screwthreaded into the rearward projection 20 of the rear wall 18*b* of chamber 18 as shown at 52. Between the eyeball 40 and the socket 30 is a sealing gasket 54 that is held in place by the retaining ring 50. When ring 50 is tightened, the inner surface of the gasket 54 is forced onto a relatively sharp circular edge 56 at the large end of the socket 30 to help assure a good seal.

It will be noted that the nozzle 40 is positioned at the center of chamber 18 and has a center point that is in alignment with the central axis of tubes 24 and 25. The nozzle itself has a center axis which is in alignment with the axis of tubes 24, 25 when the nozzle itself is straight or centered, i.e. aligned with the center axis of the chamber 18 as shown in FIG. 5. During use, it will be apparent that the nozzle 40 can be swiveled in any direction desired. In FIG. 4, it is shown at an inclined position in which it will direct water downwardly at a small angle. When the axis of the nozzle 40 is referred to herein, it will have reference to the centered position in FIG. 5. It will be noted that the free outlet ends of tubes 24 and 25, i.e. their left ends as shown in FIGS. 4 and 5, terminate in alignment with each other and are spaced from the nozzle 40. In the embodiment shown tubes 24 and 25 project a slight distance inside the nozzle 40. The inlet or cone 44 is larger in diameter than the free end of the tube 24 thereby defining an annular mouth 45 between the outside surface of tube 24 and the inlet 44 for conducting a portion of the water entering through duct 12 into the inlet 44 of the nozzle 40. This difference in size permits the ball 40 to be swiveled in all directions without striking the tube 24.

The operation of the hydrotherapy jet will now be described in connection with FIG. 5.

To use the hydrotherapy jet, an opening of the appropriate size is first bored in the wall 21 of the tub, pool or spa to receive the collar 19. The unit is then placed in the opening as shown in FIG. 4 and the water inlet 12 is directed upwardly, downwardly or to one side, i.e. at any angle with respect to the center axis of the chamber 18 which is the same as the axis of the opening in the tub 21. Because duct 12 can be pointed in any direction, the plumbing of the unit is substantially simplified. It will also be seen that no elbow or T fitting is required to attach the water supply pipe into the water supply duct 12. The collar 19 is tightened to securely retain the unit in place. It will be seen that as the unit is positioned, the mouth 26 of the air supply duct 15 remains in the same place. Because the air supply pipe is relatively small in size, it can be easily attached with or without an elbow. It can also be seen from FIG. 4 that the water inlet pipe will be located relatively close to the tub wall 21 because the hydrotherapy jet in accordance with the invention is made highly compact through compression, i.e., by placing duct 12 adjacent the nozzle chamber 18, and by positioning the axis of the inlet duct 12 in alignment with the rear wall **18*b* of the nozzle chamber 18, i.e., perpendicular to the axis of the nozzle 40**. Accordingly, the protrusion of the jet from the outer wall of the tub is minimized. The overall depth may be only about 3½ inches allowing installation in a minimum of space.

After the unit is installed in the manner described and the supply pipes connected for water and air, water under pressure is supplied through the inlet 12.

The water under pressure is supplied by a pump (not shown) that is driven by an electric motor which is typically about 0.5 for a single jet to 3 H.P. (multiple jet) providing a jet velocity of about 50 feet per second and a line pressure of about 15–20 psi. As the water flows under pressure into the inlet 12, it is directed toward the passage 22 in the nozzle around the outside of tube 24. It then flows at high speed through the mouth 45 between the free end of the tube 24 and the inlet cone 44 of the nozzle 40. A portion enters the opening 27 in pipe 25 and is expelled as shown in FIG. 5 as a fast moving stream or jet 60 into the passage within the nozzle 40. Accordingly, two water vortices exist concentric to one another and with air provided through annular duct **15*a* they are separated by an intermediate annular lamina of air 62. The inner surface of the outer water vortex 63 as well as the outer surface of the inner water vortex 60 are both exposed to the intermediate annular lamina of air 62 between them. This assists in efficient induction of air into the combined water stream 66 in the form of small bubbles 68 about 1/16" to ⅛" in diameter. Not long after the streams pass the free end of the concentric ducts 24, 25 they intersect, striking one another along a circular impact zone 64. As the two streams collide forcefully in the presence of the intermediate lamina of air, they become almost explosively disrupted to vigorously incorporate air from the annular air lamina between them. The nozzle can be swiveled by means of the extension 42** at its free end to any desired position up, down or to the side to direct the stream where desired.

In comparative tests, it was found that the invention provides substantially greater pressure as judged by placing the hand 12 inches from the open end of the nozzle when compared with similar nozzles that do not have features of the present invention. In addition, it was noticed that manometer readings taken in the air inlet duct 15 showed that vacuum was substantially greater using the present invention than a comparable prior nozzle having the same dimensions and under the same test conditions. In one test, it was found that the manometer vacuum averaged about 30% greater with the invention. This indicates much more air is incorporated into the stream flowing through the nozzle and a much stronger massaging effect can be obtained with a motor and pump of a fixed capacity. The manometer tests appear to indicate an improvement in the incorporation of air from about 50% to 400% depending on which other jet it is compared with. The invention was also effective in providing bubbles that are neither too large nor too small to achieve good operation. While the precise reason for the improvement in performance is not known with certainty, it is believed to be in part due to the greater water to air surface ratio provided by the two concentric streams and to the forceful impact between the streams in the presence of this intermediate air lamina. Thus, the invention incorporates air through two physical principles, namely, entrainment through impact and induction through an induced low pressure venturi action.

The hydrotherapy jet of the present invention can be easily produced by an injection molding using known methods. The nozzle 40 can be quickly changed to provide passages 46 of different diameters depending upon the requirements of the installation, i.e., different gallonage outputs.

If several jets are connected to a single pump, small nozzle passages are desirable to maintain the same pressure within the water piping connecting all jets.

While the invention has been shown and described in connection with the provision of the two spaced apart concentric water streams with an intermediate air stream, it is also possible to utilize two concentric spaced apart air streams with an intermediate annular water stream between them. This could be accomplished by forcing water through duct 15 and air into duct 12 but the form of the invention described previously is preferred since there is a possibility for impact between two converging water streams.

If desired, the housing and the mounting collar 19 can be electroplated with a metal coating since there are no protrusions present that will interrupt a plated coating. The term "vortex" herein is used broadly to refer to a fast moving fluid stream which usually has a twisting or swirling motion whether or not such motion is present. Flow guides or straighteners can be used to eliminate the swirl normally present but the term "vortex" herein shall still apply to such a stream.

While the invention has been described by way of example, numerous variations will be apparent to those skilled in the art within the scope of the appended claims once the principles of the invention are understood.

What is claimed is:

1. A hydrotherapy jet comprising a housing, a movable nozzle having a passage therethrough with a fluid inlet and a fluid outlet at opposite ends of the passage, the movable nozzle being supported in the housing for movement about a center point to enable the outlet to be pointed in different directions, means at the inlet end of the nozzle defining a central water stream aligned axially with the passage in the nozzle and flowing toward it, means at the inlet end of the nozzle defining an outer annular water stream also flowing toward the inlet in the nozzle, an annular air stream located between the water streams and being spaced outwardly from the axis of the passage in the nozzle whereby the impact of the two water streams vigorously striking one another enhances the entrainment of air from the intermediate lamina of air located between them to form a combined stream of water and air flowing out of said nozzle.

2. A hydrotherapy jet comprising a water supply duct means for conducting water into the jet, a swiveling nozzle means therein having a passage therethrough with an inlet and an outlet, the nozzle being adapted to be moved therein to selected positions, means defining inner and outer concentric water streams flowing into the inlet end of the passage in the swiveling nozzle, an intermediate annular lamina of air in the space between the concentric water streams whereby the inner surface of the outer stream of water and the outer cylindrical surface of the inner water stream are both exposed to the intermediate lamina of air and while the water in the concentric streams is thus exposed to the intermediate air lamina the two streams of water converge thereby striking one another forcefully and becoming disrupted to vigorously incorporate air from the intermediate annular air lamina into the combined streams.

3. A hydrotherapy jet comprising a jet housing having a water inlet duct and a ball socket therein communicating with the inlet duct, an eyeball nozzle universally mounted in the ball socket and including a nozzle passage extending therethrough with an outlet at one end and an inlet at the other end communicating with the inlet duct, a pair of concentric tubes extending away from the inlet including a central water tube aligned axially with the center of the eyeball nozzle and an outer tube surrounding the central tube and spaced from the central tube to define an annular space between itself and central concentric tube, the annular space comprising an air inlet duct displaced outwardly from the axis of the eyeball nozzle and said outer tube having an outlet end spaced from the inlet of the nozzle passage to provide a circular mouth for conducting a portion of the water into the inlet of the nozzle, the central tube and the circular mouth communicating with the water inlet duct and the annular duct between them being connected to a source of air to thereby define two concentric water vortices including one flowing through the mouth and one flowing into the passage in the nozzle from the central tube and an intermediate annular lamina of air from the annular air duct between them, the inner surface of the outer water vortex passing through the mouth and the outer cylindrical surface of the central water jet flowing out of the central tube are both exposed to the intermediate lamina of air entering through the annular air inlet duct to thereby induce air in the intermediate lamina to become incorporated into the combined water stream in the form of bubbles.

4. A hydrotherapy jet comprising a jet housing having a water inlet duct and a nozzle containment chamber defining a water outlet, said containment chamber having a side wall closed upon itself and terminating in an open rim with a mounting surface adapted to be sealed to a wall of a pool or tub, an end wall at right angles to the side wall, the water inlet duct having a center axis parallel to the end wall of the chamber and being adjacent thereto and parallel to said mounting surface, a nozzle eyeball socket centered in the end wall of the chamber, a nozzle with an eyeball universally mounted for swiveling action in the socket, said nozzle having a passage therethrough for water and air and said eyeball socket communicating with the inlet duct whereby water from the duct is free to flow into the nozzle passage, an air inlet duct having a mouth aligned with the center of the compartment such that the water entering the water inlet duct flows through the duct and then undergoes a right angle turn flowing parallel to the direction of the air flow through the air duct into the nozzle whereby a compact hydrotherapy jet is provided wherein said water inlet duct being positioned parallel to the mounting surface and the mouth of the air inlet duct is normal thereto.

5. The hydrotherapy jet of claim 4 wherein the mouth of the air duct has a central axis normal to said mounting surface and coinciding with the axis of a sidewall of the chamber such that the jet housing can be rotated on said axis to facilitate plumbing without changing the position of the mouth of the air inlet duct as the position of the water inlet duct is changed.

6. The hydrotherapy jet of claim 3 wherein said nozzle is enclosed within a nozzle containment chamber having an open rim including a tub wall engaging surface, said water inlet duct has a central axis positioned parallel to the tub wall engaging surface, said nozzle chamber has a rear wall and said water inlet duct is positioned adjacent to said rear wall thereby providing a hydrotherapy jet of compact construction.

7. The hydrotherapy jet of claim 6 wherein said air inlet duct communicates with a mouth for introducing air thereinto and the mouth of the air inlet duct is aligned with the central axis of the nozzle containment chamber whereby rotation of the hydrotherapy jet on the chamber axis will not change the position of the mouth of the air duct.

8. The jet of claim 3 wherein a retainer ring is screwthreaded into the jet housing for securing the eyeball nozzle within the housing and a sealing gasket is mounted between the ring and the housing to seal the eyeball nozzle.

9. The hydrotherapy jet of claim 1 wherein the movable nozzle includes a ball of spherical shape mounted for universal swiveling motion within the hydrotherapy jet to direct the combined stream in any selected direction.

10. The hydrotherapy jet of claim 2 wherein the two concentric water streams strike one another within said nozzle.

11. The apparatus of claim 2 wherein the hydrotherapy jet is formed from a plastic resinous material.

12. The apparatus of claim 11 wherein the jet is formed from ABS resin.

13. The apparatus of claim 11 wherein the hydrotherapy jet is formed from polyvinyl chloride.

14. The hydrotherapy jet of claim 2 wherein the swiveling nozzle includes an enlarged conical opening at the inlet end of said passage, said means defining the outer concentric water stream is a tube supported adjacent the conical opening and having a free end spaced therefrom and the free end of the tube being positioned within the conical opening in the nozzle.

* * * * *